US009203128B2

(12) United States Patent
Hoover et al.

(10) Patent No.: US 9,203,128 B2
(45) Date of Patent: Dec. 1, 2015

(54) COMPACT TWIST FOR CONNECTING ORTHOGONAL WAVEGUIDES

(71) Applicant: Honeywell International Inc.

(72) Inventors: John C. Hoover, Fernandina Beach, FL (US); Lance Covert, Norcross, GA (US)

(73) Assignee: Honeywell International Inc., Morristown, NJ (US)

( * ) Notice: Subject to any disclaimer, the term of this patent is extended or adjusted under 35 U.S.C. 154(b) by 399 days.

(21) Appl. No.: 13/652,684

(22) Filed: Oct. 16, 2012

(65) Prior Publication Data

US 2014/0104017 A1 Apr. 17, 2014

(51) Int. Cl.

| | |
|---|---|
| ***H01P 1/02*** | (2006.01) |
| ***H01P 1/17*** | (2006.01) |
| ***H01P 1/06*** | (2006.01) |

(Continued)

(52) U.S. Cl.

CPC ..... *H01P 1/022* (2013.01); *H01P 1/065* (2013.01); *H01P 1/165* (2013.01); *H01P 1/173* (2013.01); *H01P 5/082* (2013.01); *Y10T 29/49016* (2015.01)

(58) Field of Classification Search

CPC ..... H01P 1/165; H01P 1/042; H01P 5/02; H01P 5/04; H01P 1/02; H01P 1/022; H01P 1/17; H01P 1/065; H01P 1/173; H01P 5/08; H01P 5/082; Y10T 29/49016

USPC ..... 333/21 A, 254, 33–35

See application file for complete search history.

(56) References Cited

U.S. PATENT DOCUMENTS

| | | | |
|---|---|---|---|
| 2,729,794 | A | 1/1956 | Cohn |
| 2,975,383 | A | 3/1961 | Seling |

(Continued)

FOREIGN PATENT DOCUMENTS

| | | |
|---|---|---|
| DE | 3537354 | 4/1987 |
| EP | 0392999 | 10/1990 |

(Continued)

OTHER PUBLICATIONS

European Patent Office, "Rule 71(3) from EP Application No. 13179001.6 mailed Sep. 29, 2014", "from Foreign Counterpart of U.S. Appl. No. 13/652,684", Sep. 29, 2014, pp. 1-32, Published in: EP.

(Continued)

*Primary Examiner* — Benny Lee
*Assistant Examiner* — Albens Dieujuste
(74) *Attorney, Agent, or Firm* — Fogg & Powers LLC

(57) ABSTRACT

A compact interfacing device for rotating electro-magnetic fields between an input and output waveguide includes a support bar extending between opposing sides of a frame, the frame encircling an interior space divided by the support bar; and a dipole bar orientated orthogonal to the support bar. When the input waveguide interfaces an input-side of the frame and is arranged so that an extent of an input width of the input waveguide is orientated at first angle with respect to an extent of the dipole-bar length, and when the output waveguide interfaces an output-side of the frame and is arranged so that an extent of an output width of the output waveguide is orientated at a second angle with respect to the extent of the dipole-bar length, an input electric field aligned perpendicular to the extent of the input width is rotated upon propagating through the compact interfacing device.

15 Claims, 9 Drawing Sheets

(51) Int. Cl.

| | |
|---|---|
| ***H01P 1/165*** | (2006.01) |
| ***H01P 5/08*** | (2006.01) |

(56) References Cited

U.S. PATENT DOCUMENTS

| | | | |
|---|---|---|---|
| 6,031,434 | A | 2/2000 | Tatomir et al. |
| 6,087,908 | A | 7/2000 | Haller et al. |
| 6,225,875 | B1 | 5/2001 | Kich |
| 6,313,714 | B1 | 11/2001 | Junker et al. |
| 6,724,277 | B2 | 4/2004 | Holden et al. |
| 6,756,861 | B2 | 6/2004 | Rosenberg et al. |
| 6,879,221 | B2 | 4/2005 | Beis et al. |
| 7,212,087 | B2 | 5/2007 | Nagai |
| 7,330,088 | B2 | 2/2008 | Aramaki et al. |
| 7,656,359 | B2 | 2/2010 | Haziza |
| 7,808,337 | B2 | 10/2010 | Rosenberg et al. |
| 7,847,652 | B1 | 12/2010 | Chen et al. |
| 2001/0011933 | A1 | 8/2001 | Enokuma |
| 2004/0246062 | A1 | 12/2004 | Asao et al. |
| 2009/0309674 | A1 | 12/2009 | Girard et al. |
| 2011/0037534 | A1 | 2/2011 | Espino et al. |
| 2012/0032867 | A1 | 2/2012 | Fonseca |
| 2012/0039566 | A1 | 2/2012 | Ruiz Cruz et al. |
| 2014/0104014 | A1 | 4/2014 | Hoover et al. |

FOREIGN PATENT DOCUMENTS

| | | |
|---|---|---|
| EP | 2355234 | 8/2011 |
| WO | 2005034278 | 4/2005 |
| WO | 2008008702 | 1/2008 |

OTHER PUBLICATIONS

Bornemann et al., "Edge-Conditioned Vector Basis Functions for the Analysis and Optimization of Rectangular Waveguide Dual-Mode Filters", Jun. 1999, pp. 1-4.

Dunning, "Double Ridged Orthogonal Mode Transducer for the 16-26GHz Microwave Band", Feb. 2002, pp. 1-3, Publisher: CSIRO Australia Telescope National Facility.

Hwang et al., "Compact Orthomode Transducer using Single-Ridged Triangular Waveguides", "IEEE Microwave and Wireless Components letters", Aug. 2011, pp. 412-414.

Rosenberg, "A Compact and Broadband 90-Degree Waveguide Twist Transformer for Integrated Waveguide Subsystems", Sep. 2001, pp. 1-4.

European Patent Office, "European Search Report from EP Application No. 13179001.6 mailed Jan. 27, 2014", "from Foreign Counterpart of U.S. Appl. No. 13/652,684", Jan. 27, 2014, pp. 1-3, Published in: EP.

European Patent Office, "Office Action from EP Application No. 13179001.6 mailed Feb. 10, 2014", "from Foreign Counterpart of U.S. Appl. No. 13/652,684", Feb. 10, 2014, pp. 1-3, Published in: EP.

COMPACT TWIST FOR CONNECTING ORTHOGONAL WAVEGUIDES

This invention was made with Government support under Contract No. F33657-02-D-0009 awarded by F22, United States Air Force. The Government has certain rights in the invention.

BACKGROUND

In the packaging of a waveguide system it is sometimes necessary to change the axial orientation of the waveguide by 90 degrees along the length of a waveguide run. For example, the axial orientation of the waveguide may be required to change from an H-plane orientation to an E-plane orientation or the other way around. For a linearly-polarized antenna, an E-plane is the plane containing the electric field vector in the direction of maximum radiation. An H-plane is the plane containing the magnetic field vector in the direction of maximum radiation. The magnetizing field or H-plane is orthogonal to the E-plane.

The electric field or E-plane determines the polarization and orientation of the radio wave. For a vertically-polarized antenna, the E-plane usually coincides with the vertical/elevation plane and the H-plane coincides with the horizontal/azimuth plane. For a horizontally-polarized antenna, the E-plane usually coincides with the horizontal/azimuth plane and the H-plane coincides with the vertical/elevation plane.

Some systems require the rotation of the electro-magnetic fields from an H-plane orientation to an E-plane orientation. A twist or rotation of the E-field is done by a waveguide that physically forces the rotation of the orientation of the E-field (and H-field) by 90 degrees as the electro-magnetic (EM) radiation propagates along the length of the waveguide. A waveguide that physically forces the rotation of the E-field orientation requires a relatively long waveguide length.

Some systems, such as a power dividing network for an antenna array, require the rotation from an H-plane orientation to an E-plane orientation to occur over a very short distance so the twist (rotation of the E-field) occurs in the shortest length possible. Some shorter length twists are currently available. In one example, a quarter wavelength section orientated at 45 degrees is placed between the orthogonal waveguides. In another example, a resonant iris orientated at 45 degrees is placed between the orthogonal waveguides. A resonant iris can take various forms but is typically an approximately half wavelength slot at the desired frequency, separating the input and output sections of waveguide. Both the quarter wavelength section and the resonant iris have a narrow bandwidth and are sensitive to bandwidth. A resonant iris is also sensitive to machining tolerances due to narrow gaps in the iris.

SUMMARY

The present application relates to a compact interfacing device for rotating electro-magnetic fields between an input waveguide and an output waveguide. The interfacing device includes a support bar extending between and connected to opposing sides of a frame. The support bar has a support-bar length and a support-bar thickness. The frame encircles an interior space divided by the support bar. The frame has a frame thickness. The interfacing device also includes a dipole bar orientated orthogonal to the support bar. The dipole bar has a dipole-bar thickness and a dipole-bar length that is less than the support-bar length. When the input waveguide interfaces an input-side of the frame and is arranged so that an extent of an input width of the input waveguide is orientated at first angle with respect to an extent of the dipole-bar length, and when the output waveguide interfaces an output-side of the frame and is arranged so that an extent of an output width of the output waveguide is orientated at a second angle with respect to the extent of the dipole-bar length, an input electric field aligned perpendicular to the extent of the input width is rotated upon propagating through the compact interfacing device so that an output electric field aligned perpendicular to the extent of the output width is coupled to the output waveguide. The second angle is equal to and opposite the first angle.

DRAWINGS

In accordance with common practice, the various described features are not drawn to scale but are drawn to emphasize features relevant to the present invention. Like reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense.

The "compact interfacing device" described herein is also referred to herein as a "compact twist". In one embodiment, the compact twist is operably positioned between an input waveguide and an orthogonally arranged output waveguide to rotate electro-magnetic fields over a short distance so as to couple electro-magnetic radiation emitted from an H-plane orientated input waveguide to a E-plane orientated output waveguide (or vice versa). This rotation of the EM radiation is referred to herein as a twisting of the EM fields. In another implementation of this embodiment, the compact twist is operably positioned between an input waveguide and an output waveguide arranged with an angle θ between the largest extend of the input and output waveguides, so that the compact twist rotates electro-magnetic fields by the angle θ over a short distance. In one implementation of this embodiment, the compact twist is operably positioned between an input waveguide and an output waveguide arranged at an angle, θ, with respect to each other, where θ does not equal either 0 degrees or 90 degrees. In this latter case, the compact twist is operable to rotate electro-magnetic fields by the angle θ over a short distance. This embodiment is described below with reference to FIG. 6.

As defined herein, "a short distance" is either: much less than the shortest dimension of the input waveguide supporting the electro-magnetic radiation incident on and rotated by the compact twist; or much less than a quarter of the guided wavelength. In one implementation of this embodiment, a short distance is 25% less than the shortest dimension of the input waveguide supporting the electro-magnetic radiation incident on and rotated by the compact twist. In another implementation of this embodiment, a short distance is 25% less than a quarter of the guided wavelength. In yet another implementation of this embodiment, a short distance is 10% less than the shortest dimension of the input waveguide supporting the electro-magnetic radiation incident on and rotated by the compact twist. In yet another implementation of this embodiment, a short distance is 10% less than a quarter of the guided wavelength.

Figure 1:
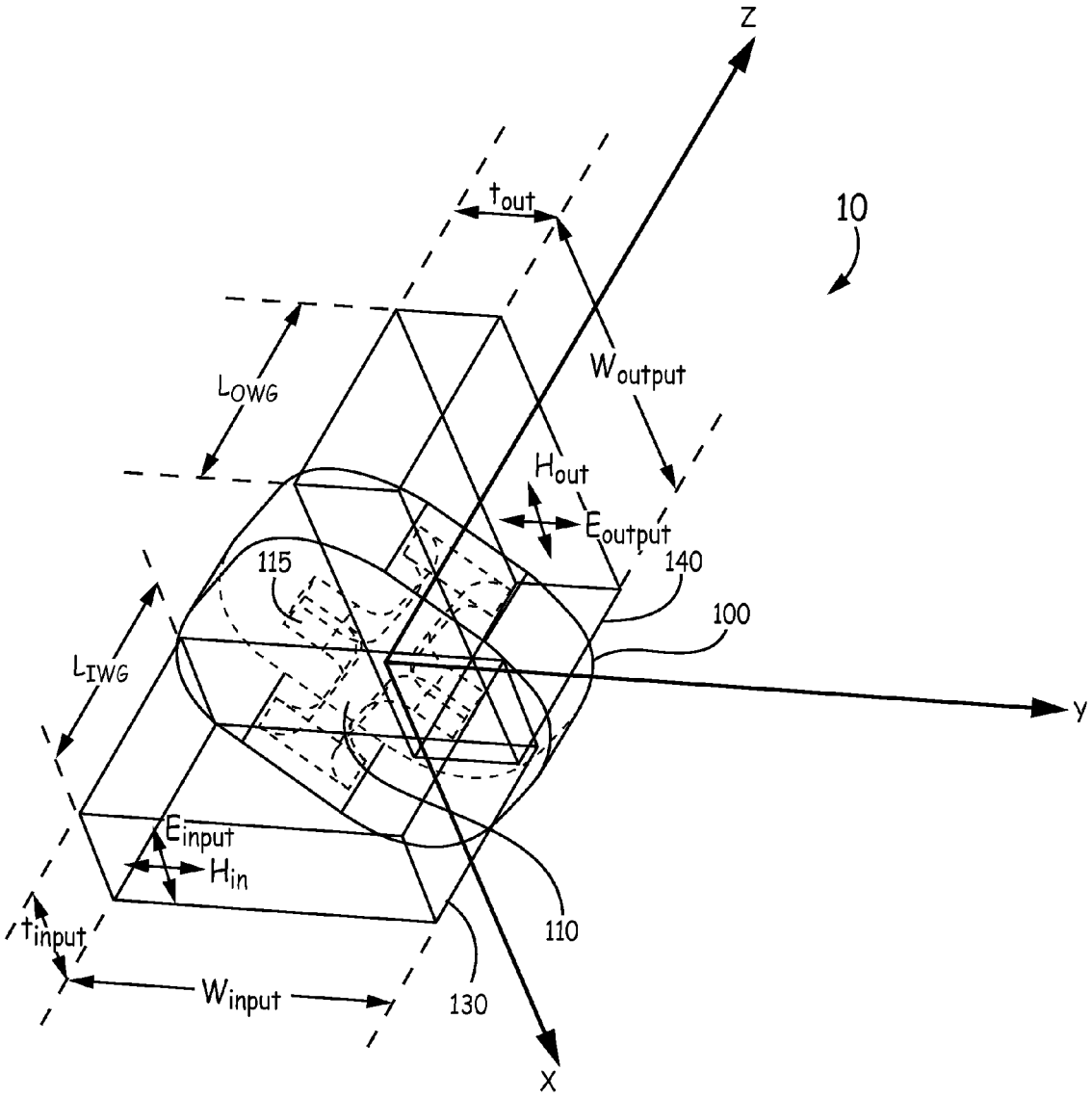
FIG. 1 is an oblique view of one embodiment of a waveguide system including a compact interfacing device, an input waveguide, and an orthogonally arranged output waveguide in accordance with the present invention.
Figure 2A:
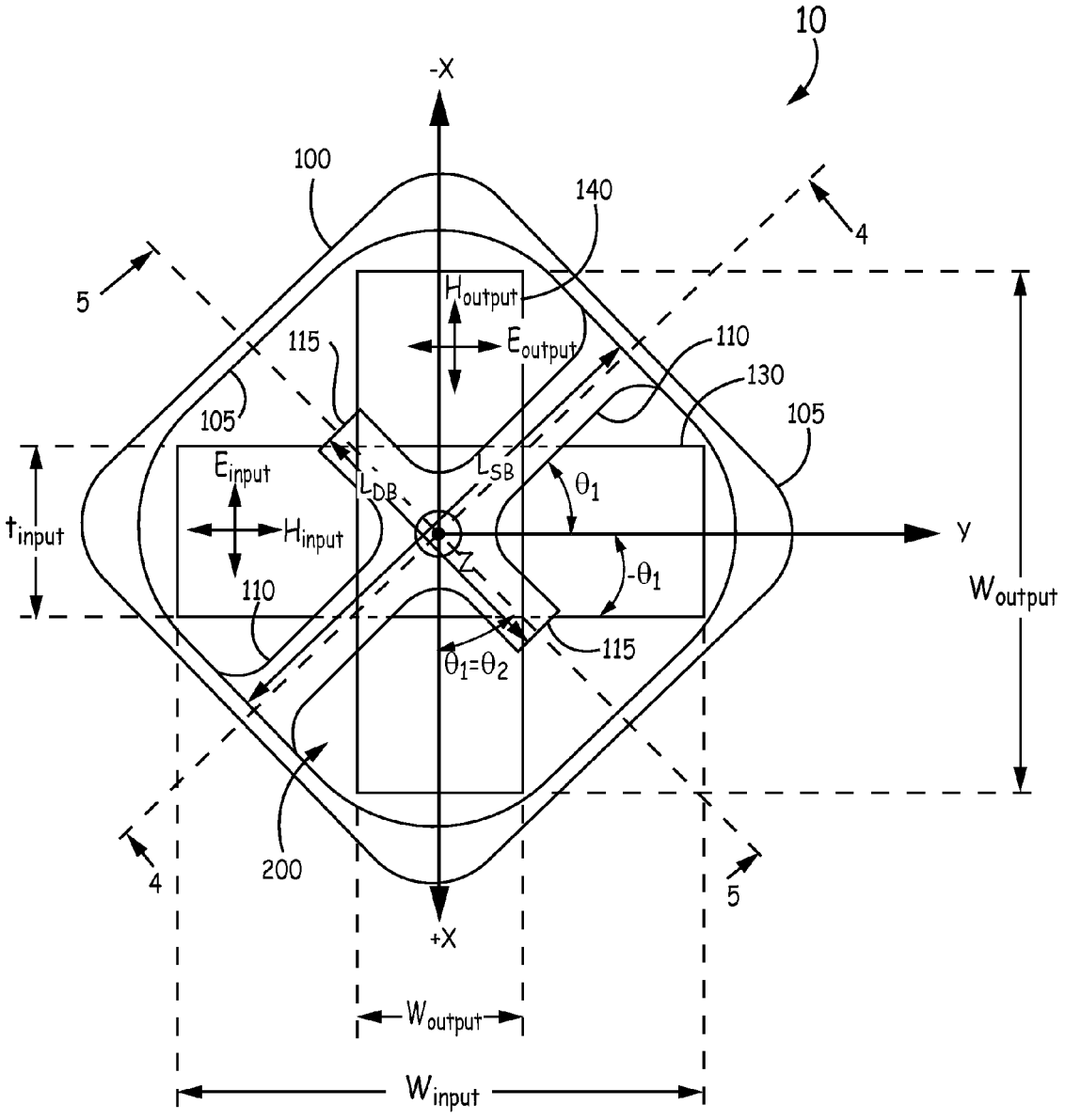
FIG. 2A is a top view of the waveguide system of FIG. 1.
Figure 2B:
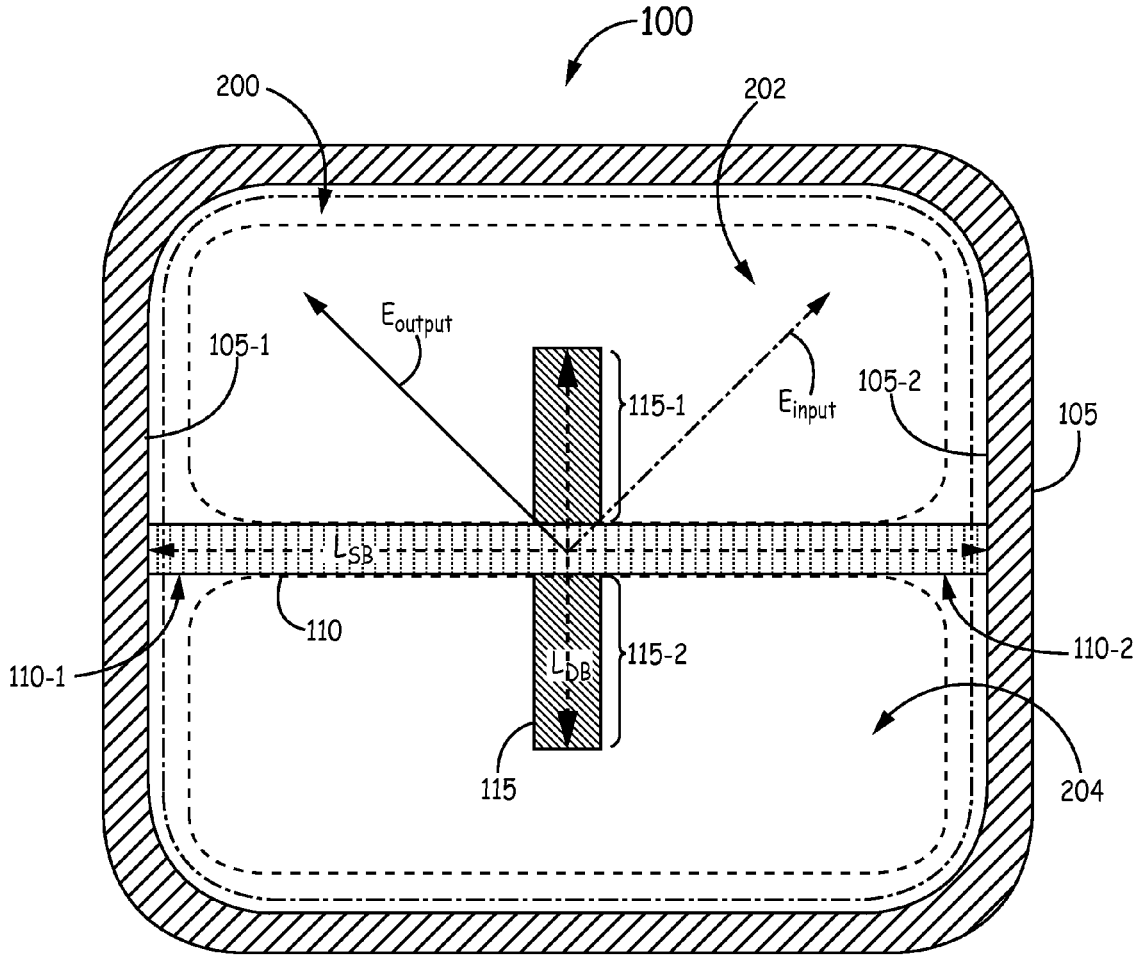
FIG. 2B is a top view of the compact interfacing device of FIG. 1.
Figure 3:
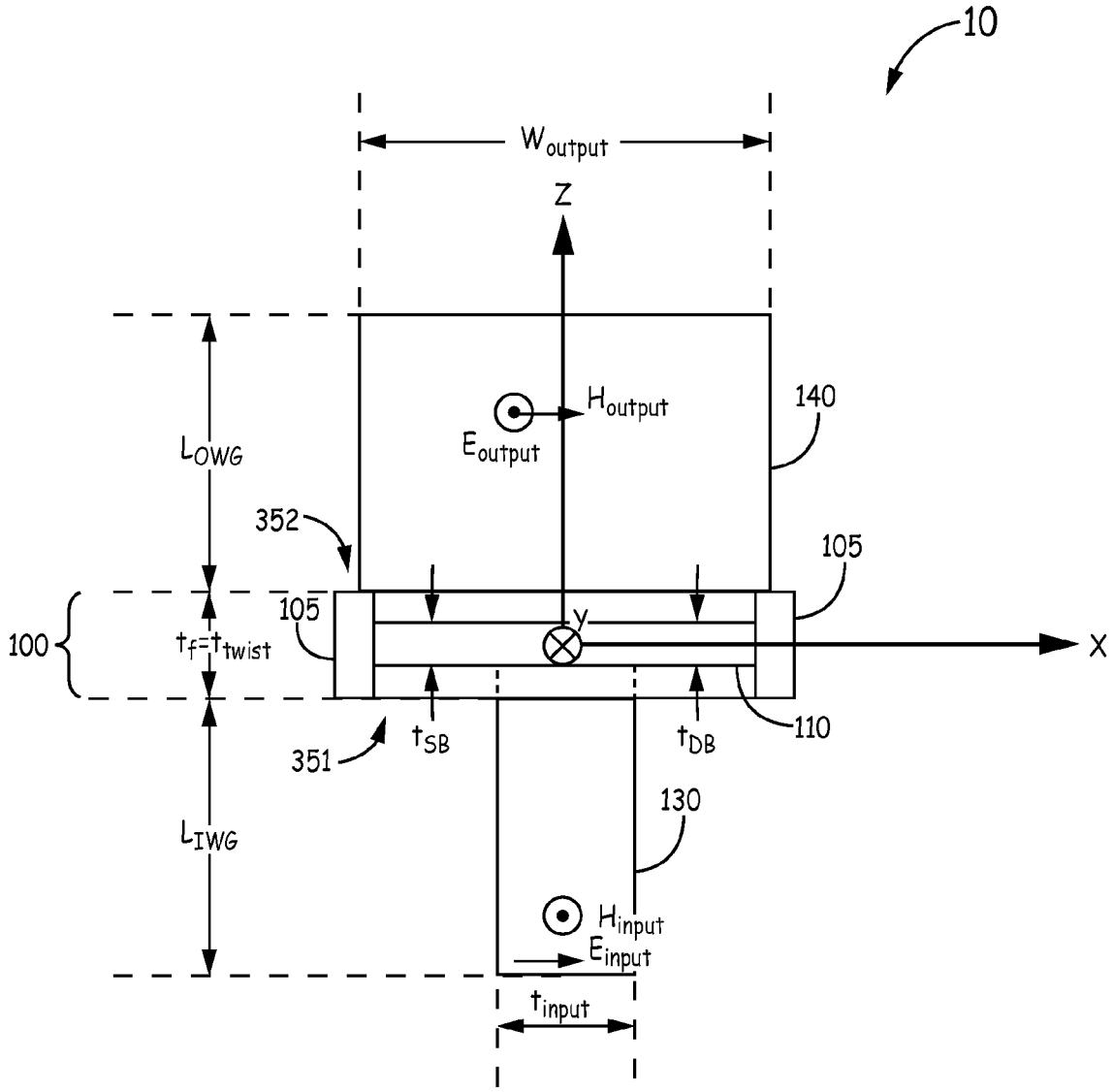
FIG. 3 is a side view of the waveguide system as viewed along the y axis.
Figure 4:
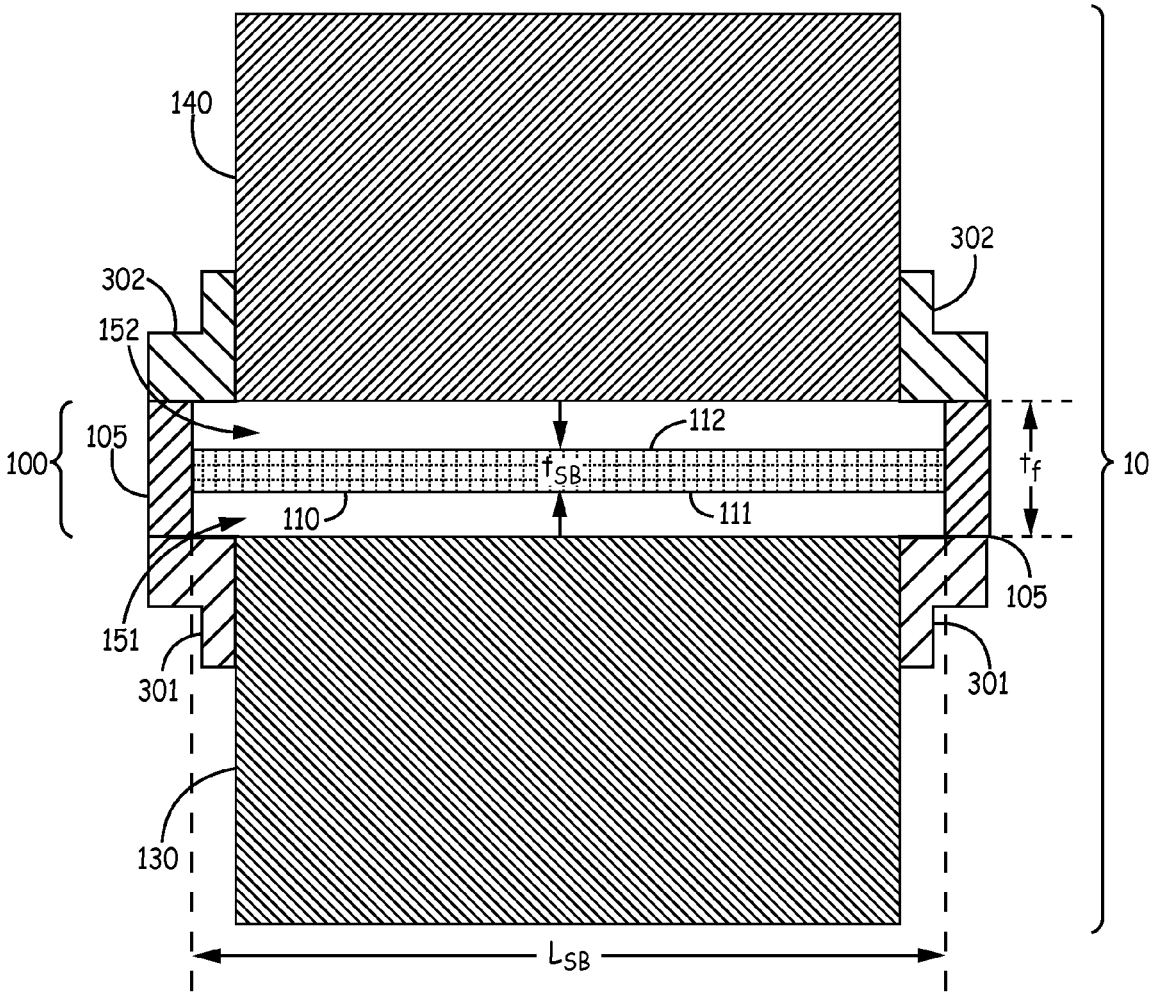
FIG. 4 is a first cross-sectional side view of the waveguide system of FIGS. 1 and 2A.
Figure 5:
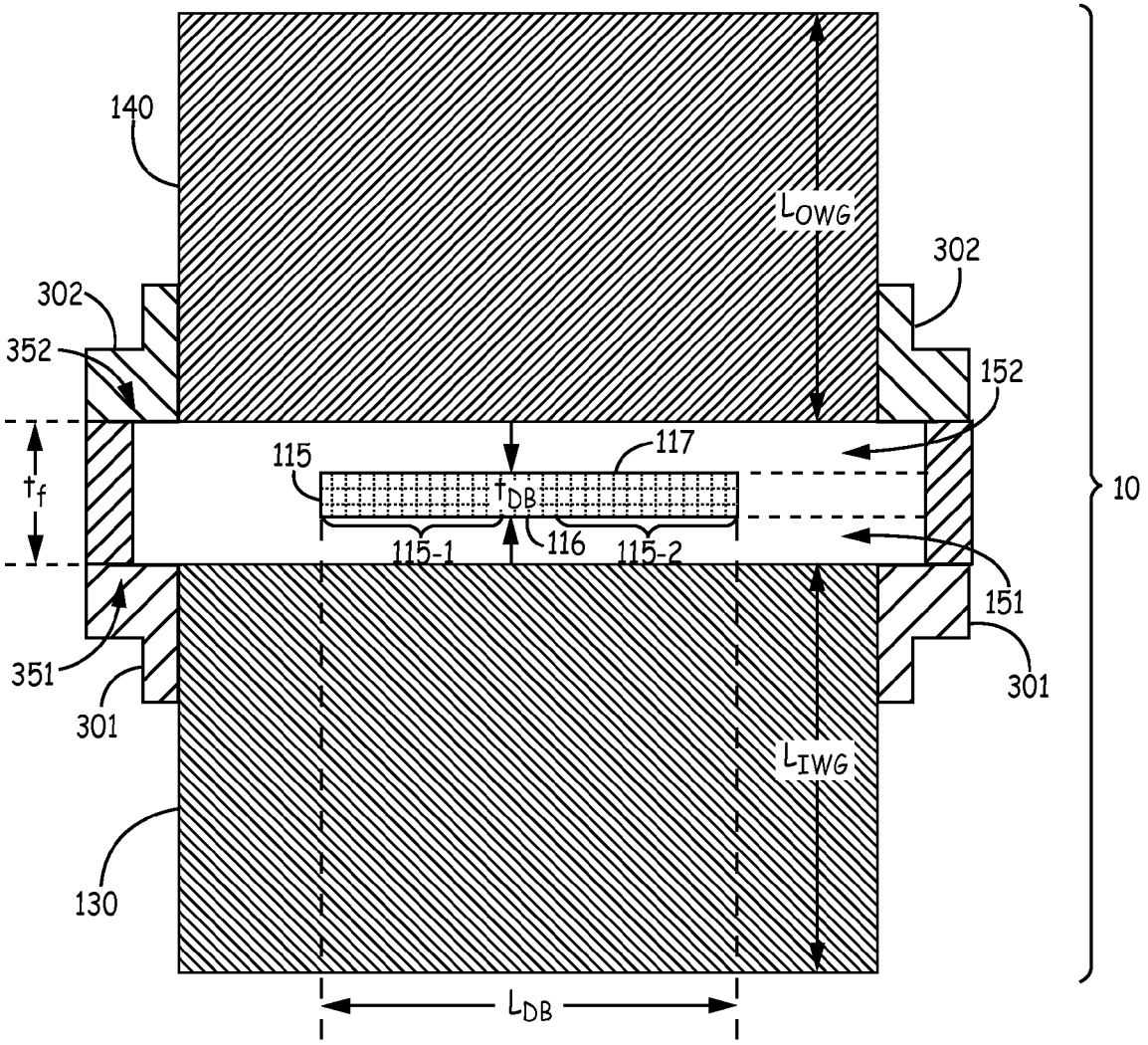
FIG. 5 is a second cross-sectional side view of the waveguide system of FIGS. 1 and 2A.

FIG. 1 is an oblique view of one embodiment of a waveguide system 10 including a compact interfacing device 100, an input waveguide 130, and an orthogonally arranged output waveguide 140 in accordance with the present invention. FIG. 2A is a top view of the waveguide system of FIG. 1. FIG. 2B is a top view of the compact interfacing device of FIG. 1. The input waveguide 130 and the output waveguide 140 are not shown in FIG. 2B. FIGS. 3-5 are various side views of the waveguide system of FIG. 1. FIG. 3 is a side view of the waveguide system 10 as viewed along the y axis. FIG. 4 is a first cross-sectional side view of the waveguide system 10 of FIGS. 1 and 2A. The plane upon which the cross-section view of FIG. 4 is taken is indicated by section line 4-4 in FIG. 2A. FIG. 5 is a second cross-sectional side view of the waveguide system 10 of FIGS. 1 and 2A. The plane upon which the cross-section view of FIG. 5 is taken is indicated by section line 5-5 in FIG. 2A. The "compact interfacing device 100" is also referred to herein as "compact twist 100".

The compact interfacing device 100 includes a frame 105, a support bar 110, and a dipole bar 115. The support bar 110 extends between and is connected to opposing sides 105-1 and 105-2 (FIG. 2B) of the frame 105. A first end 110-1 of the support bar 110 connects to the side 105-1 of the frame 105. A second end 110-2 of the support bar 110 connects to the side 105-2 of the frame 105. The support bar 110 has a support-bar length $L_{SB}$ (FIGS. 2A, 2B, and 4) and a support-bar thickness $t_{SB}$ (FIGS. 3 and 4).

The dipole bar 115 is orientated orthogonal to the support bar 110 and has a dipole-bar thickness $t_{DB}$ (FIGS. 3 and 5) and a dipole-bar length $L_{DB}$ (FIGS. 2A, 2B, and 5) that is less than the support-bar length $L_{SB}$. As shown in FIG. 2B, the dipole bar 115 intersects the support bar 110 at half the support-bar length $L_{SB}$. Likewise, the support bar 110 intersects the dipole bar 115 at half the dipole-bar length $L_{DB}$. The dipole bar 115 is formed from a conductive material such as metal or plastic coated with metal. The dipole-bar length $L_{DB}$ of the dipole bar 115 is on the order of half a wavelength λ of the EM radiation that is rotated by the compact interfacing device 100. The EM radiation incident on the dipole bar 115 causes the free electrons in the dipole bar 115 to oscillate. Specifically, when EM radiation with a wavelength of about $\lambda=2\ L_{DB}$ is incident on the dipole bar 115, the incident radiation generates an alternating current $I=I_0e^{1\omega}$ in the dipole bar 115, where $\omega=2\ \pi f$ is the angular frequency, and the EM wavelength is $\lambda=c/f$. The signal incident on the dipole bar 115 from the input waveguide 130 induces an alternating current on the dipole bar 115, which is, in turn, coupled from the dipole bar 115 to the output waveguide 140.

The frame 105 encircles an interior space represented generally at 200 (FIGS. 2A and 2B). The interior space 200 is divided in half by the support bar 110. As shown in FIG. 2B, the support bar 100 divides the interior space 200 into a first space represented generally at 202 and a second space represented generally at 204 (FIG. 2B). Thus, the support bar 100 forms two approximately equal open areas 202 and 204 in the frame 105 on opposite sides of the support bar 100. The two open areas 202 and 204 are each partially bisected by respective portions of the dipole bar 115. Specifically, the first open area 202 (first space 202) is partially bisected by the first portion 115-1 of the dipole bar 115 and the second open area 204 (second space 204) is partially bisected by the second portion 115-2 of the dipole bar 115.

The interior space 200 of the frame 105 includes an insertion region 151 (FIGS. 4 and 5) on a first side 116 of the dipole bar 115 and on a first side 111 of the support bar 110. The interior space 200 of the frame 105 includes an exit region 152 (FIGS. 4 and 5) on a second side 117 of the dipole bar 115 and on a second side 112 of the support bar 110. The second side 117 of the dipole bar 115 opposes the first side 116 of the dipole bar 115. The second side 112 of the support bar 110 opposes the first side 111 of the support bar 110.

In one implementation of this embodiment, the compact interfacing device 100 also includes flanges 301 and 302, which are only shown in FIGS. 4 and 5 to reduce the complexity of FIGS. 1, 2A, and 3. As shown in FIGS. 4 and 5, the compact interfacing device 100 includes a first flange 301 to position an output-face of the input waveguide 130 at the input-side represented generally at 351 of the frame 105. The compact interfacing device 100 includes a second flange 302 to position an input-face of the output waveguide 140 at an output-side represented generally at 352 of the frame 105. In this manner, the input waveguide 130 interfaces an input-side 351 of the frame 105 and the output waveguide 140 interfaces an output-side 352 of the frame 105.

The input waveguide 130 has an input width $W_{input}$, a thickness $t_{input}$, and a length $L_{IWG}$. The width $W_{input}$ has an extent that is parallel to the y axis shown in FIGS. 1, 2A, and 3. The thickness $t_{input}$ has an extent that is parallel to the x axis shown in FIGS. 1, 2A, and 3. The length $L_{IWG}$ has an extent that is parallel to the z axis.

The output waveguide 140 has an output width $W_{output}$, a thickness $t_{output}$ (shown as $t_{out}$ in FIG. 1), and a length $L_{OWG}$. The width $W_{output}$ has an extent that is parallel to the x axis shown in FIGS. 1, 2A, and 3. The thickness $t_{output}$ has an extent that is parallel to the y axis shown in FIGS. 1, 2A, and 3. The length $L_{OWG}$ has an extent that is parallel to the z axis.

The waveguide system 10 is operably configured as shown in FIG. 2A to rotate an EM field by twice the angle $\theta_1$. The compact interfacing device 100 is configured to rotate electro-magnetic fields ($E_{input}$-$H_{input}$ and $E_{output}$-$H_{output}$) between the input waveguide 130 and the orthogonally arranged output waveguide 140. $H_{input}$ is shown in FIG. 1 as $H_{input}$. $H_{output}$ is shown in FIG. 1 as $H_{output}$. Specifically, the compact interfacing device 100 inputs electro-magnetic fields $E_{input}$-$H_{input}$ from an input waveguide 130, and rotates the input electro-magnetic fields $E_{input}$-$H_{input}$ by 90 degrees, so that output electro-magnetic fields $E_{output}$-$H_{output}$ are coupled to an orthogonally arranged output waveguide 140.

As shown in FIG. 2A, the length $L_{SB}$ of the support bar 110 has an extent that is at an angle $\theta_1$ with reference to the y axis and the length $L_{DB}$ of the dipole bar 115 has an extent that is at an angle $-\theta_1$ with reference to the y axis. As shown in FIG. 2A, the input width $W_{input}$ of the input waveguide 130 is arranged so that an extent of the input width $W_{input}$ is orientated at a first angle $-\theta_1$ with respect to an extent (dipole-bar length $L_{DB}$) of the dipole bar 115. The output width $W_{output}$ of the output waveguide 140 is arranged so that an extent of the output width $W_{output}$ is orientated at a second angle $\theta_2=\theta_1$ with respect to the extent (dipole-bar length $L_{DB}$) of the dipole bar 115.

In the exemplary embodiment shown in FIG. 2A, the angle $\theta_1$ is 45 degrees and the angle $-\theta_1$ is −45 degrees (the negative of the angle of $\theta_1$ degrees). As shown in FIGS. 1, 2A, and 3, the E-field $E_{input}$ propagating within the input waveguide 130 is oriented parallel to the x axis (e.g., parallel to the extent of the input thickness $t_{input}$ of the input waveguide 130). Thus, as shown in FIGS. 1, 2A, and 3, the E-field $E_{input}$ is input to the compact interfacing device 100 with an orientation of 45 degrees to the extent of the support-bar length $L_{SB}$ of the support bar 110 and with an orientation of 45 degrees to the extent of support-bar length $L_{DB}$ of the dipole bar 115.

The input EM radiation ($E_{input}$-$H_{input}$) propagates in the z direction toward the input side 351 (FIGS. 3 and 5) of the compact twist 100. The input magnetic field ($H_{input}$) in input to the compact interfacing device 100. The compact twist 100 causes a 90 degree rotation (i.e., a rotation of twice the orientation of 45 degrees to the extent of the dipole-bar length $L_{SB}$) of the input magnetic field ($H_{input}$) so that the output magnetic field ($H_{output}$) is coupled to the output waveguide 140.

The output EM radiation ($E_{output}$-$H_{output}$) propagates in the z direction away from the output side 352 (FIGS. 3 and 5) of the compact twist 100. The output waveguide 140 supports propagation of the output magnetic field ($H_{output}$) that is aligned parallel to the extent of the output thickness $t_{output}$ of the output waveguide 140.

In one implementation of this embodiment, the support-bar thickness $t_{SB}$ is about equal to the dipole-bar thickness $t_{DB}$ and the frame thickness $t_f$ is greater than the support-bar thickness $t_{SB}$ and the dipole-bar thickness $t_{DB}$. The frame thickness $t_f$ is an insertion length of the compact interfacing device 100 for rotating electro-magnetic fields. The dipole-bar thickness $t_{DB}$ is much less than input width $W_{input}$ of the input waveguide 130 and the output width $W_{output}$ of the output waveguide 140. In yet another implementation of this embodiment, the input width $W_{input}$ of the input waveguide 130 is about equal to the output width $W_{output}$ of the output waveguide 140. In yet another implementation of this embodiment, the input waveguide 130 is a single mode waveguide. In yet another implementation of this embodiment, the output waveguide 140 is a single mode waveguide.

Figure 6:
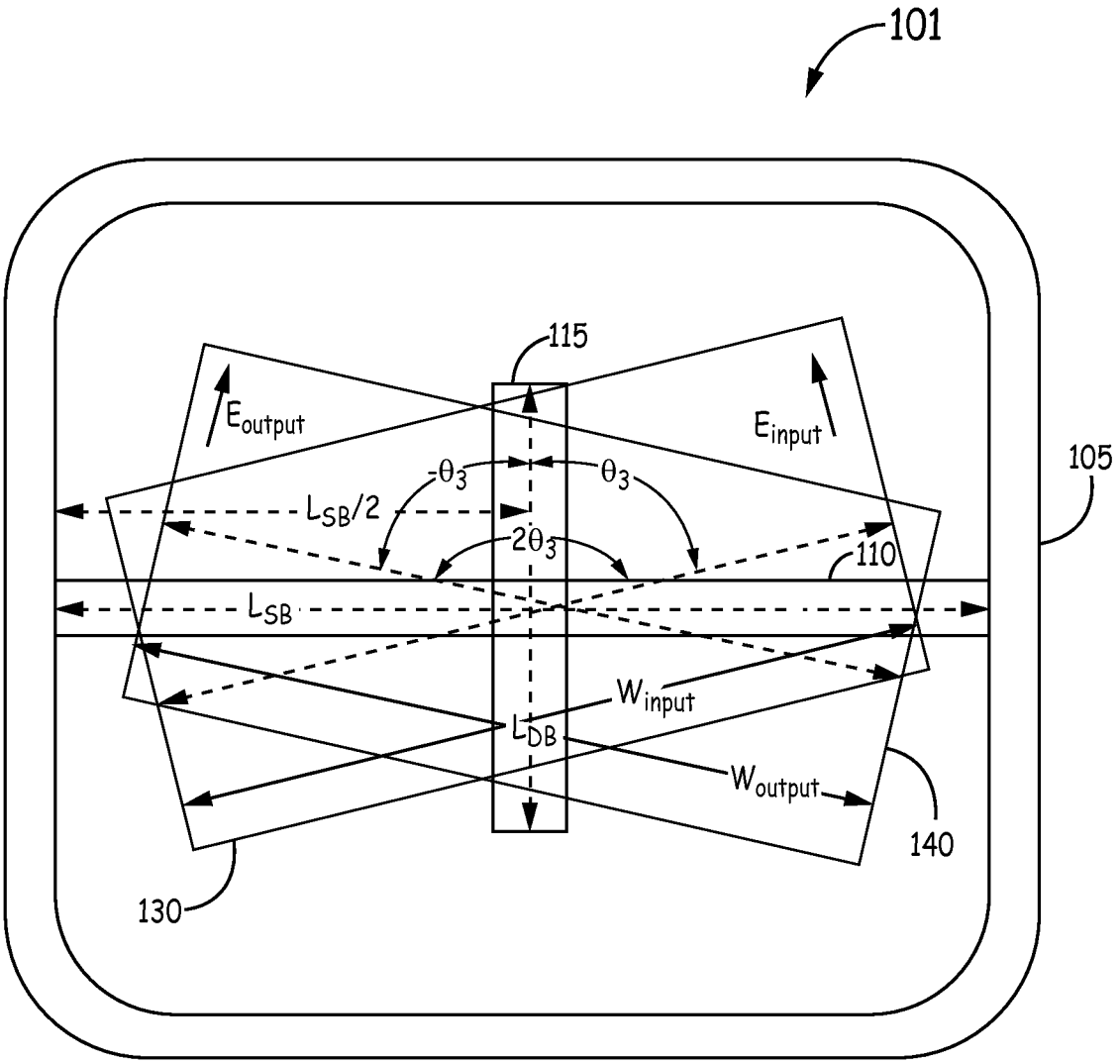
FIG. 6 is a top view of one embodiment of a waveguide system including compact interfacing device, an input waveguide, and an output waveguide in accordance with the present invention.

FIG. 6 is an oblique view of one embodiment of a compact interfacing device 101 to rotate electro-magnetic fields by $2\theta_3$ for coupling from an input waveguide 130 and to an output waveguide 140 that is arranged with an orientation of $2\theta_3$ in accordance with the present invention. As shown in FIG. 6, an extent of the width $W_{input}$ of the input waveguide 130 is arranged at an angle $\theta_3$ degrees from the extent of the dipole bar 115 and the extent of the width $W_{output}$ of the output waveguide 140 is arranged at an angle $-\theta_3$ degrees (the negative of the angle of $\theta_3$ degrees) from the extent of the dipole bar 115. The compact interfacing device 101 inputs electro-magnetic fields $E_{input}$-$H_{input}$ from an input waveguide 130, and rotates the input electro-magnetic fields $E_{input}$-$H_{input}$ by twice $\theta_3$ degrees, so that output electro-magnetic fields $E_{output}$-$H_{output}$ are coupled to an output waveguide 140 that has a width $W_{output}$ that is orientated at $2\theta_3$ degrees from the width $W_{input}$ of the input waveguide 130. It is to be noted that the angle $\theta_3$ or $-\theta_3$ degrees is always measured from the extent of the dipole bar 115 and the absolute value of $\theta_3$ is greater than 0 degrees and less than 90 degrees.

Figure 7:
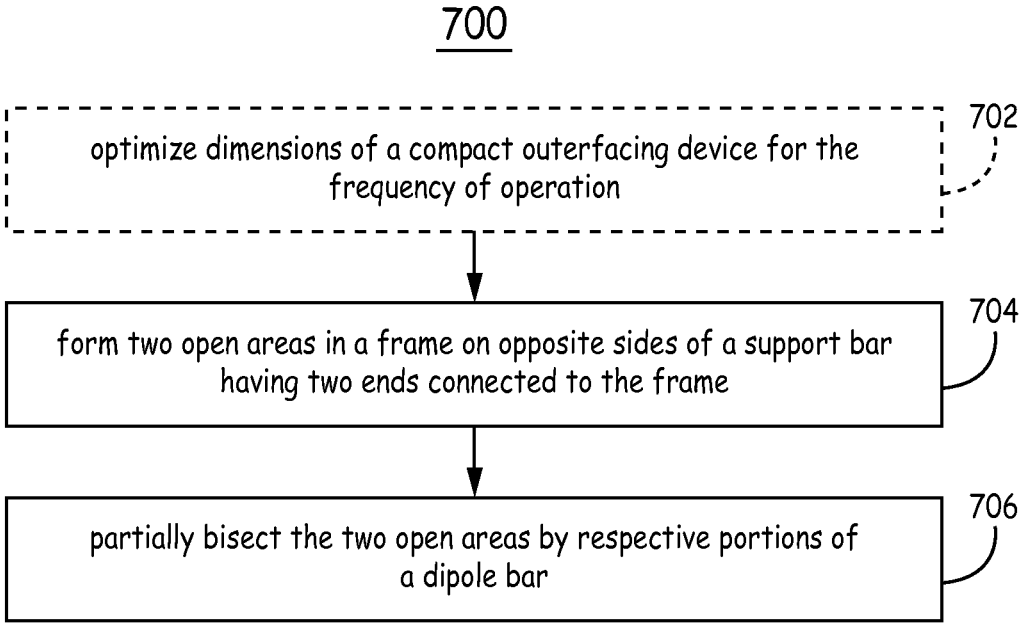
FIG. 7 is a flow diagram of one embodiment of a method to make a compact interfacing device in accordance with the present invention.

FIG. 7 is a flow diagram of a method 700 of making a compact interfacing device 100. Block 702 is optional. At block 702, the dimensions of a compact interfacing device 100 are optimized for the frequency of operation. The optimizing can be done either empirically or by modeling. Method 700 is described with reference to FIG. 2B.

At block 704, two open areas 202 and 204 are formed are in a frame 105 on opposite sides of a support bar having two ends connected to the frame 105. At block 706, the two open areas 202 and 204 are partially bisected by respective portions 115-1 and 115-2 of a dipole bar 115. In one implementation of this embodiment, forming two open areas 202 and 204 in the frame 105 partially bisected by the dipole bar 115 includes machining a metal disc to form the two open areas partially bisected by the respective portions of the dipole bar.

In another implementation of this embodiment, forming two open areas 202 and 204 in the frame 105 partially bisected by the dipole bar 115 includes forming a mold configured to form the frame, the support bar, and the dipole bar orientated orthogonal to the support bar. Then molten plastic is forced into the mold to form the frame, the support bar, and the dipole bar. The plastic is released from the mold after the plastic has set. The molded plastic is coated with metal. In this embodiment, the blocks 704 and 706 occur at the same time since the two open areas 202 and 204 are formed at about the same time as the portions 115-1 and 115-2 of the dipole bar 115 are formed.

In yet another implementation of this embodiment, forming two open areas 202 and 204 in the frame 105 partially bisected by the dipole bar 115 includes printing the frame, the support bar, and the dipole bar in three dimensions (3D) in metal.

In yet another implementation of this embodiment, forming two open areas 202 and 204 in the frame 105 partially bisected by the dipole bar 115 includes printing the frame, the support bar, and the dipole bar in three dimensions (3D) in plastic. The printed plastic frame, the plastic support bar, and the plastic dipole bar are coated with metal.

Figure 8:
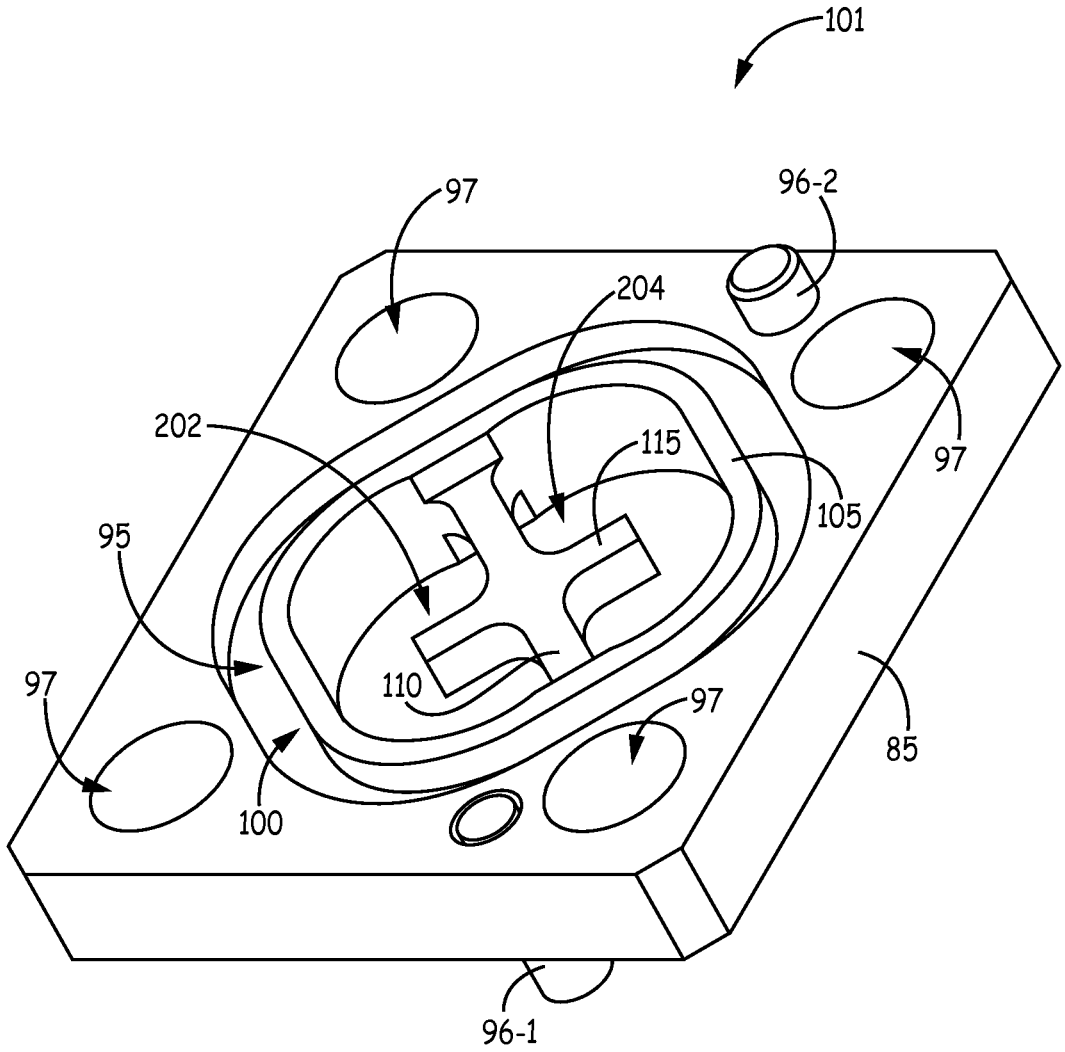
FIG. 8 is an oblique view of one embodiment of a compact interfacing device in accordance with the present invention.

FIG. 8 is an oblique view of one embodiment of a compact interfacing device 101 in accordance with the present invention. As shown in FIG. 8, the compact interfacing device 101 is formed within a support structure 85. The frame 105 is suspended (suspension features not shown) inside the support structure 85 with an open area 95 at least partially surrounding the the compact interfacing device 100. In one implementation of this embodiment, the frame 105 is part of the support structure 85. Studs 96-1 and 96-2 are alignment pins for the input waveguide 130 and the output waveguide 140. Flange holes 97 are also used to aide in the alignment of the input waveguide 130 and the output waveguide 140 to the compact interfacing device 100.

EXAMPLE EMBODIMENTS

Example 1 includes a compact interfacing device for rotating electro-magnetic fields between an input waveguide and an output waveguide, the interfacing device comprising: a support bar extending between and connected to opposing sides of a frame, the support bar having a support-bar length and a support-bar thickness; the frame encircling an interior space divided by the support bar, the frame having a frame thickness; and a dipole bar orientated orthogonal to the support bar, the dipole bar having a dipole-bar thickness and a dipole-bar length that is less than the support-bar length, wherein when the input waveguide interfaces an input-side of the frame and is arranged so that an extent of an input width of the input waveguide is orientated at first angle with respect to an extent of the dipole-bar length, and when the output waveguide interfaces an output-side of the frame and is arranged so that an extent of an output width of the output waveguide is orientated at a second angle with respect to the extent of the dipole-bar length, the second angle being equal to and opposite the first angle, an input electric field aligned perpendicular to the extent of the input width is rotated upon propagating through the compact interfacing device so that an output electric field aligned perpendicular to the extent of the output width is coupled to the output waveguide.

Example 2 includes the compact interfacing device of Example 1, further comprising: a first flange to position an output-face of the input waveguide at the input-side of the frame; and a second flange to position an input-face of the output waveguide at an output side of the frame.

Example 3 includes the compact interfacing device of any of Examples 1-2, wherein the dipole bar intersects the support bar at half the support-bar length.

Example 4 includes the compact interfacing device of any of Examples 1-3, wherein the support-bar thickness is about equal to the dipole-bar thickness and wherein the frame thickness is greater than the support-bar thickness and the dipole-bar thickness, wherein the frame thickness is an insertion length of the compact interfacing device for rotating electro-magnetic fields, wherein the dipole-bar thickness is much less than the input width and the output width.

Example 5 includes the compact interfacing device of any of Examples 1-4, wherein the first angle is 45 degrees and the second angle is −45 degrees.

Example 6 includes the compact interfacing device of any of Examples 1-5, wherein the dipole-bar length is on the order of half a wavelength of the rotated electro-magnetic fields.

Example 7 includes the compact interfacing device of any of Examples 1-6, wherein the input width is about equal to the output width.

Example 8 includes the compact interfacing device of any of Examples 1-7, wherein the input waveguide is a single mode waveguide.

Example 9 includes the compact interfacing device of any of Examples 1-8, wherein the output waveguide is a single mode waveguide.

Example 10 includes a method of making a compact interfacing device, the method comprising: forming two open areas in a frame on opposite sides of a support bar having two ends connected to the frame; and partially bisecting the two open areas by respective portions of a dipole bar.

Example 11 includes the method of Example 10, wherein forming two open areas in the frame comprises: machining a metal disc, to form the two open areas partially bisected by the respective portions of the dipole bar.

Example 12 includes the method of Example 10, wherein forming two open areas in the frame comprises: forming a mold configured to form the frame, the support bar extending between and connected to opposing sides of the frame, and the dipole bar orientated orthogonal to the support bar, the dipole bar being unattached to the frame; forcing molten plastic into the mold to form the frame, the support bar, and the dipole bar; releasing the plastic from the mold after the plastic has set; and coating the molded plastic with metal.

Example 13 includes the method of Example 10, wherein forming two open areas in the frame comprises: printing the frame, the support bar, and the dipole bar in three dimensions (3D) in metal.

Example 14 includes the method of Example 10, wherein forming two open areas in the frame comprises: printing the frame, the support bar, and the dipole bar in three dimensions (3D) in plastic; and coating the printed plastic frame, the plastic support bar, and the plastic dipole bar with metal.

Example 15 includes a waveguide system comprising: an input waveguide configured to support an input electric field propagating along a length of the input waveguide, the input electric field being perpendicular to an extent of an input width of the input waveguide; an output waveguide configured to support an output electric field propagating along a length of the output waveguide, the output electric field being perpendicular to an extent of an output width of the output waveguide, wherein the extent of the input width is orientated at a first angle with respect to the extent of the output width; and a compact interfacing device positioned between the input waveguide and the output waveguide, wherein the compact interfacing device is configured to rotate the input electric field by the first angle, and wherein the compact interfacing device has an insertion length that is much less than the shortest dimension of the input waveguide and much less than the shortest dimension of the output waveguide.

Example 16 includes the waveguide system of Example 15, wherein interfacing device comprises: a support bar extending between and connected to opposing sides of a frame, the support bar having a support-bar length and a support-bar thickness; a dipole bar orientated orthogonal to the support bar, the dipole bar having a dipole-bar thickness and a dipole-bar length that is less than the support-bar length; and the frame encircling an interior space divided by the support bar, the frame having a frame thickness, wherein the dipole-bar thickness is greater than the support-bar thickness and greater than the frame thickness, wherein when the extent of the input width is orientated at a second angle with respect to an extent of the dipole-bar length, the second angle being half of the first angle, and when the extent of the output width is orientated at the negative of the second angle with respect to the extent of the dipole-bar length, then the input electric field supported in the input waveguide is rotated through the first angle by the interfacing device so that the output electric field is supported in the output waveguide.

Example 16 includes the waveguide system of Example 15, wherein the interfacing device comprises: a support bar extending between and connected to opposing sides of a frame, the support bar having a support-bar length and a support-bar thickness; a dipole bar orientated orthogonal to the support bar, the dipole bar having a dipole-bar thickness and a dipole-bar length that is less than the support-bar length; and the frame encircling an interior space divided by the support bar, the frame having a frame thickness, wherein the frame thickness is greater than the support-bar thickness and greater than the dipole-bar thickness, wherein when the input waveguide having an input width is arranged so that an extent of the input width is orientated at a second angle with respect to an extent of the dipole-bar length, the second angle being half of the first angle; and when the output waveguide having an output width is arranged so that an extent of the output width is orientated at the opposite of the second angle with respect to the extent of the dipole-bar length, then an input electric field supported in the input waveguide and aligned to propagate perpendicular to the extent of the input width, is coupled to the output waveguide, and wherein an output electric field supported in the output waveguide is aligned to propagate perpendicular to the extent of the output width.

Example 17 includes the waveguide system of any of Examples 15-16, wherein the interior space of the frame is divided by the support bar into a first open region and a second open region, and wherein a first portion of the dipole bar partially bisects the first open region, and wherein a second portion of the dipole bar partially bisects the second open region.

Example 18 includes the waveguide system of any of Examples 15-17, wherein the interior space of the frame includes: an insertion region on a first side of the dipole bar and on a first side of the support bar; and an exit region on a second side of the dipole bar and on a second side of the support bar, the second side of the dipole bar opposing the first side of the dipole bar and the second side of the support bar opposing the first side of the support bar.

Example 19 includes the waveguide system of any of Examples 15-18, wherein the dipole bar intersects the support bar at half the support-bar length.

Example 20 includes the waveguide system of any of Examples 15-16, wherein the support-bar thickness is much less than the input width and the output width, and wherein the frame thickness is much less than the input width and the output width.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A compact interfacing device for rotating electro-magnetic fields between an input waveguide and an output waveguide, the interfacing device comprising:

a support bar extending between and connected to opposing sides of a frame, the support bar having a support-bar length and a support-bar thickness;

the frame encircling an interior space divided by the support bar, the frame having a frame thickness; and a dipole bar orientated orthogonal to the support bar, the dipole bar having a dipole-bar thickness and a dipole-bar length that is less than the support-bar length, wherein when the input waveguide interfaces an input-side of the frame and is arranged so that an extent of an input width of the input waveguide is orientated at a first angle with respect to an extent of the dipole-bar length, and when the output waveguide interfaces an output-side of the frame and is arranged so that an extent of an output width of the output waveguide is orientated at a second angle with respect to the extent of the dipole-bar length, the second angle being equal to and opposite the first angle, wherein an input electric field aligned perpendicular to the extent of the input width is rotated upon propagating through the compact interfacing device so that an output electric field, which is aligned perpendicular to the extent of the output width, is coupled to the output waveguide.

2. The compact interfacing device of claim 1, further comprising:

a first flange to position an output-face of the input waveguide at the input-side of the frame; and a second flange to position an input-face of the output waveguide at the output-side of the frame.

3. The compact interfacing device of claim 1, wherein the dipole bar intersects the support bar at half the support-bar length.

4. The compact interfacing device of claim 1, wherein the support-bar thickness is about equal to the dipole-bar thickness and wherein the frame thickness is greater than the support-bar thickness and the dipole-bar thickness, wherein the frame thickness is an insertion length of the compact interfacing device for rotating electro-magnetic fields, wherein the dipole-bar thickness is much less than the input width and the output width.

5. The compact interfacing device of claim 1, wherein the first angle is 45 degrees and the second angle is −45 degrees.

6. The compact interfacing device of claim 1, wherein the dipole-bar length is on the order of half a wavelength of the rotated electro-magnetic fields.

7. The compact interfacing device of claim 1, wherein the input width is about equal to the output width.

8. The compact interfacing device of claim 1, wherein the input waveguide is a single mode waveguide.

9. The compact interfacing device of claim 1, wherein the output waveguide is a single mode waveguide.

10. A waveguide system comprising:

an input waveguide configured to support an input electric field propagating along a length of the input waveguide, the input electric field being perpendicular to an extent of an input width of the input waveguide;

an output waveguide configured to support an output electric field propagating along a length of the output waveguide, the output electric field being perpendicular to an extent of an output width of the output waveguide, wherein the extent of the input width is orientated at a first angle with respect to the extent of the output width; and a compact interfacing device positioned between the input waveguide and the output waveguide, the compact interfacing device including:

a support bar extending between and connected to opposing sides of a frame, the support bar having a support-bar length and a support-bar thickness;

a dipole bar orientated orthogonal to the support bar, the dipole bar having a dipole-bar thickness and a dipole-bar length that is less than the support-bar length; and the frame encircling an interior space divided by the support bar, the frame having a frame thickness that equals an insertion length, wherein the compact interfacing device is configured to rotate the input electric field by the first angle, and wherein the insertion length is much less than a shortest one of the input width, a thickness, and the length of the input waveguide and much less than a shortest one of the output width, a thickness, and the length of the output waveguide.

11. The waveguide system of claim 10, wherein the frame thickness is greater than the support-bar thickness and greater than the dipole-bar thickness, wherein when the extent of the input width is orientated at a second angle with respect to an extent of the dipole-bar length, the second angle being half of the first angle, and when the extent of the output width is orientated at a negative of the second angle with respect to the extent of the dipole-bar length, then the input electric field supported in the input waveguide is rotated through the first angle by the interfacing device so that the output electric field is supported in the output waveguide.

12. The waveguide system of claim 11, wherein the interior space of the frame is divided by the support bar into a first open region and a second open region, and wherein a first portion of the dipole bar partially bisects the first open region, and wherein a second portion of the dipole bar partially bisects the second open region.

13. The waveguide system of claim 11, wherein the interior space of the frame includes:

an insertion region on a first side of the dipole bar and on a first side of the support bar; and an exit region on a second side of the dipole bar and on a second side of the support bar, the second side of the dipole bar opposing the first side of the dipole bar and the second side of the support bar opposing the first side of the support bar.

14. The waveguide system of claim 11, wherein the dipole bar intersects the support bar at half the support-bar length.

15. The waveguide system of claim 11, wherein the support-bar thickness is much less than the input width and the output width, and wherein the frame thickness is much less than the input width and the output width.

* * * * *